United States Patent [19]

McMillan

[11] 3,945,460

[45] Mar. 23, 1976

[54] MUFFLER WITH RUPTURE CONTROL MEANS

[75] Inventor: Robert H. McMillan, Columbus, Ind.

[73] Assignee: Arvin Industries, Inc., Columbus, Ind.

[22] Filed: Sept. 3, 1974

[21] Appl. No.: 502,447

[52] U.S. Cl. ..... 181/61; 181/35 C

[51] Int. Cl.[2] ..... F01N 7/18

[58] Field of Search ..... 181/35 C, 61–62

[56] References Cited

UNITED STATES PATENTS

| | | | |
|---|---|---|---|
| 2,981,057 | 4/1961 | Buttler | 181/62 |
| 3,289,785 | 12/1966 | Walker | 181/35 C |
| 3,306,393 | 2/1967 | Straw | 181/62 |
| 3,648,803 | 3/1972 | Heath | 181/61 |

*Primary Examiner*—L. T. Hix
*Assistant Examiner*—Vit W. Miska
*Attorney, Agent, or Firm*—Jenkins, Hanley & Coffey

[57] ABSTRACT

A muffler for attenuating the exhaust gas noise from an internal combustion engine in which there is an elongated shell having a pair of end caps rigidly secured to the ends thereof. Inlet and outlet conduits are mounted in said end caps and are operatively connected to sound attenuating means carried within the shell for reducing the noise level of the exhaust gases entering the muffler through the inlet conduit and exiting through the outlet conduit. Intermediate its length the shell has a groove formed therein to thus form a fracture point in the shell for controlling the location of a rupture in the muffler in the event that the muffler is subjected to an excessive number of backfires.

2 Claims, 3 Drawing Figures

MUFFLER WITH RUPTURE CONTROL MEANS

BACKGROUND OF THE INVENTION

In the operation of an internal combustion engine, as in an automotive vehicle, the engine on occasion misfires. This sends a charge of air and gasoline vapors through the exhaust system. This charge tends to collect in the muffler, and when the engine again fires properly, it ignites the vapor mixture resulting in a backfire. During such a backfire, the entire muffler rapidly expands, and then it contracts. After a number of such backfires, the muffler will rupture at its weakest point which in conventional mufflers is normally the connection between one of the muffler end caps and the muffler shell. However, such a rupture can occur at any point on the muffler.

When a muffler so ruptures, the hot exhaust gases can escape therefrom and create a safety hazard. For example, should such a rupture occur near the fuel lines, the hot exhaust gases from the ruptured muffler may be directed toward said fuel lines with the attendant possibility of explosion or fire.

In order to overcome this problem, it has been proposed to employ a muffler having a double outer shell with aligned lockseams extending the length of the shells so that any rupture will occur along the length of those seams. However, in such construction, the connections between the muffler end caps and the shells are strengthened and rigidized to insure that a rupture does not occur at the interconnections between the end caps and shells. The strengthening of these interconnections obviously creates additional manufacturing operations and increases the cost of manufacturing such mufflers.

The instant invention provides a means for controlling the point of rupture in a muffler when it is subjected to a successive number of backfires without substantially increasing the cost of manufacture of the muffler.

BRIEF DESCRIPTION OF THE DRAWINGS

The accompanying drawings illustrate the invention. In such drawings.

DETAILED DESCRIPTION OF THE PREFERRED EMBODIMENT

Figure 1:
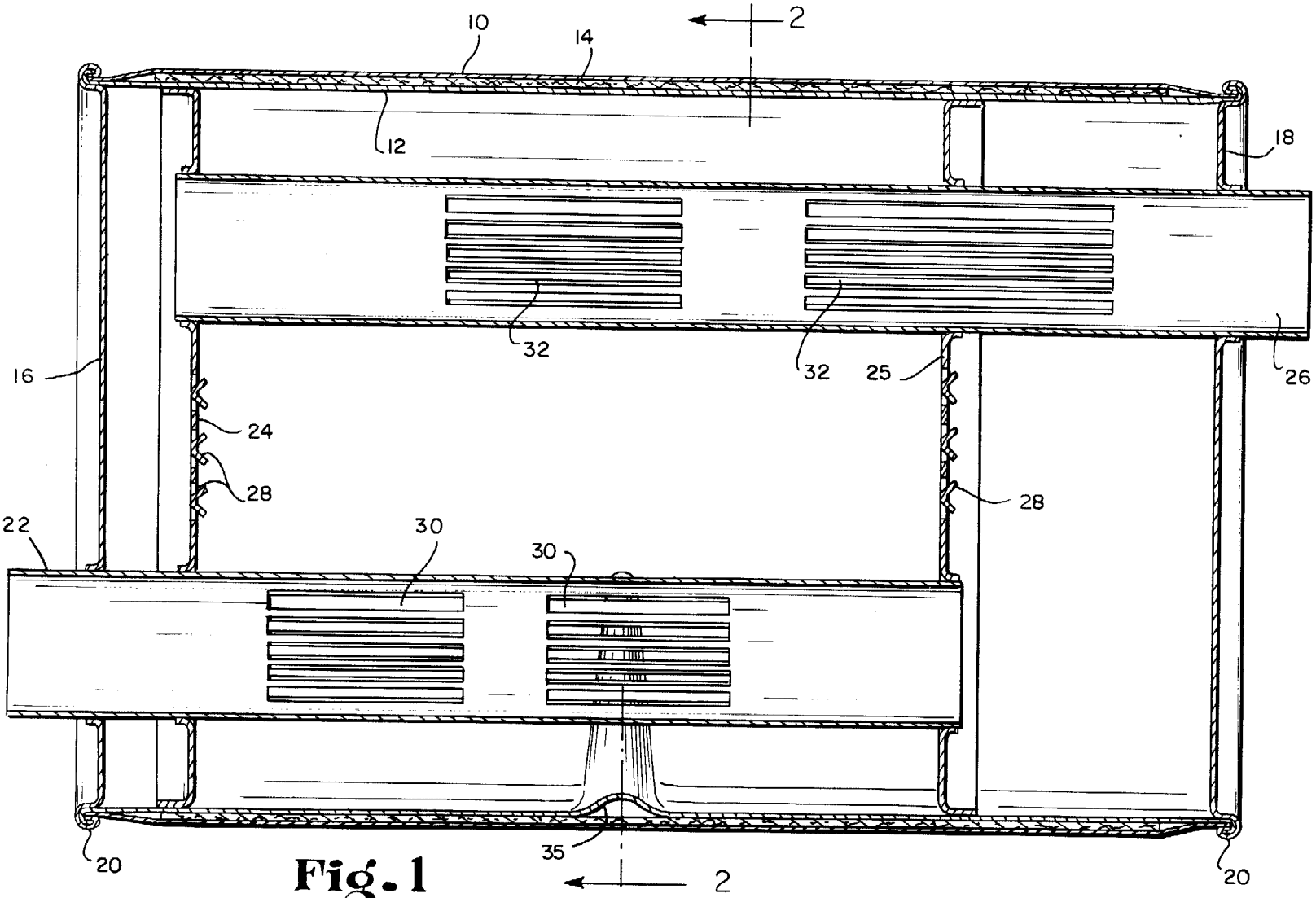
FIG. 1 is a longitudinal section of a muffler embodying the invention.

The illustrated embodiment of the invention employs a shell assembly having a pair of shells. As shown, said assembly has an outer elongated shell 10 and an inner elongated shell 12 with an asbestos wrap 14 interposed between the shells 10 and 12. The shells 10 and 12 which are formed from sheet-metal are in the form of coaxially aligned closed curves with shell 10 having its lockseam 15 disposed out of alignment with the lockseam 17 on shell 12. Shell 12 is formed of a heavier gauge metal than shell 10, with shell 10 serving to hold the asbestos wrap 14 in position in the shell assembly.

Figure 3:
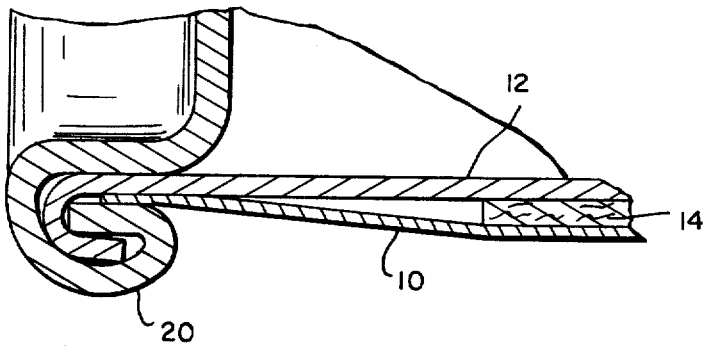
FIG. 3 is an enlarged vertical section showing one of the end cap-shell interconnections shown in FIG. 1.

The ends of the shell assembly are closed by a pair of end caps 16 and 18 which are substantially identical in their construction. As shown in FIG. 3, each of the end caps is connected to the adjacent end of the shells 10 and 12, as by a conventional lockseam 20.

The structure of the sound attenuating chambers within the muffler forms no part of the instant invention. In the illustrated embodiment, gas enters the muffler through an inlet conduit 22 mounted in the end cap 16 and supported within the muffler on a pair of longitudinally spaced baffle plates 24 and 25. The gas is discharged from the muffler through an exhaust conduit 26 mounted in the end cap 18 and supported in the baffle plates 24 and 25. Each of the baffle plates 24 and 25 is provided with a plurality of louvered openings 28, and the inlet and outlet conduits 22 and 26 are also provided with pluralities of louvered openings 30 and 32, respectively. Thus, the baffle plates act in combination with the end caps to provide a plurality of sound attenuating chambers for reducing the noise level of the gases passing through the muffler.

Figure 2:
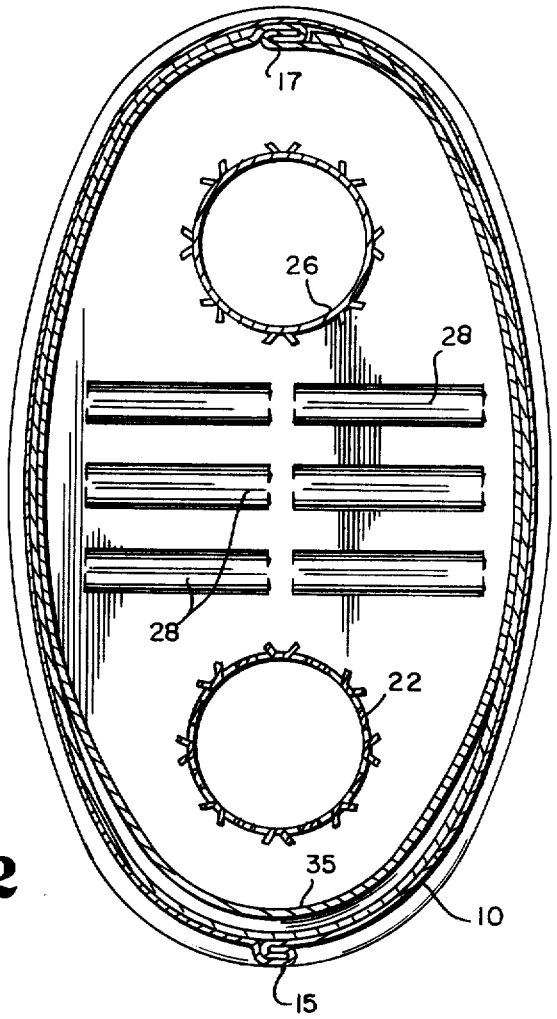
FIG. 2 is a vertical section taken on the line 2—2 of FIG. 1.

The muffler construction described above is conventional. My invention resides in forming a groove or channel 35 in the shell 12 intermediate its length. As shown in FIGS. 1 and 2, the groove 35 projects inwardly from the general curved plane of the shell and extends around slightly less than one half of the circumference of shell 12. The groove 35 in essence forms a weakened area in the shell, which when subjected to the stretching and contracting forces of backfires, will fatigue and split open thereby permitting the explosive force of the backfire and the gases to escape through the fractured grooved area of the shell. When an outer shell and wrap are employed in the shell assembly, such as shell 10 and wrap 14, said outer shell and wrap will also fracture or rupture in the area of the fractured groove 35.

Since the groove 35 defines a predetermined location where the muffler will rupture, it can be oriented on the muffler in a location such that when the muffler is mounted on an automotive vehicle the groove will be located on the bottom side of the muffler. This permits the gases escaping through the fractured groove to be directed downwardly toward the road and thus away from fuel tanks and lines, brake lines, etc.

I claim:

1. A muffler, comprising a shell assembly having inner and outer sheet-metal shells disposed in coaxial alignment, an asbestos wrap interposed between said shells, a pair of end caps connected to the ends of said shells for closing the ends thereof, inlet and outlet conduits mounted in at least one of said end caps, sound attenuating means mounted in said shell, and a groove formed in said inner shell intermediate its length and extending partially therearound, said groove being separate from said sound attenuating means and forming a weakened section in said shell.

2. A muffler as set forth in claim 1 in which said inner shell is formed from a heavier gauge of metal than said outer shell.

* * * * *